United States Patent [19]

Gramling

[11] Patent Number: 4,700,775

[45] Date of Patent: Oct. 20, 1987

[54] DUAL-ACTION RETRIEVING TOOL FOR OIL WELL SWABS

[76] Inventor: William D. Gramling, 5144 Newport Ave., Chevy Chase, Md. 20816

[21] Appl. No.: 832,444

[22] Filed: Feb. 24, 1986

[51] Int. Cl.[4] ..... E21B 31/18; E21B 31/20

[52] U.S. Cl. ..... 166/98; 294/86.24; 294/86.29; 294/86.33

[58] Field of Search ..... 166/98, 99, 117.5; 294/86.24, 86.29, 86.33

[56] References Cited

FOREIGN PATENT DOCUMENTS 1134945 8/1962 Fed. Rep. of Germany ..... 166/98

*Primary Examiner*—Stephen J. Novosad

[57] ABSTRACT

Apparatus and method for a tool that will retrieve either an oil well swab or the down-hole stand which limits the working depth of the swab.

4 Claims, 3 Drawing Figures

DUAL-ACTION RETRIEVING TOOL FOR OIL WELL SWABS

FIELD OF THE INVENTION

Retrieval tools for gas and oil well swabs and associated down-hole stands.

DESCRIPTION OF PRIOR ART

There is a wide variety of "fishing" tools available to the oil industry. Most are expensive and, because of this, are usually rented. The advent of inexpensive gas and oil well swabs such as that described in U.S. Pat. No. 4,070,134 necessitates the inclusion of a specialized retrieval tool for extracting these swabs and the associated down-hole stands from the wells.

SUMMARY OF THE INVENTION

Apparatus and method of inexpensively retrieving the gas and oil well swab and associated down-hole stand as described in U.S. Pat. No. 4,070,134.

DESCRIPTION OF THE PREFERRED EMBODIMENTS

The oil well swab, as described by U.S. Pat. No. 4,070,134, utilizes a fishing head in the form of a rod, about $\frac{7}{8}$ inch in diameter, with a slot cut near the top for gripping. The fishing head of the down-hole stand is in the form of an upwardly-facing open tube, about $3\frac{1}{2}$ inches in diameter, having a horizontal slot cut internally about $\frac{1}{2}$ inch from the top.

Figure 1:
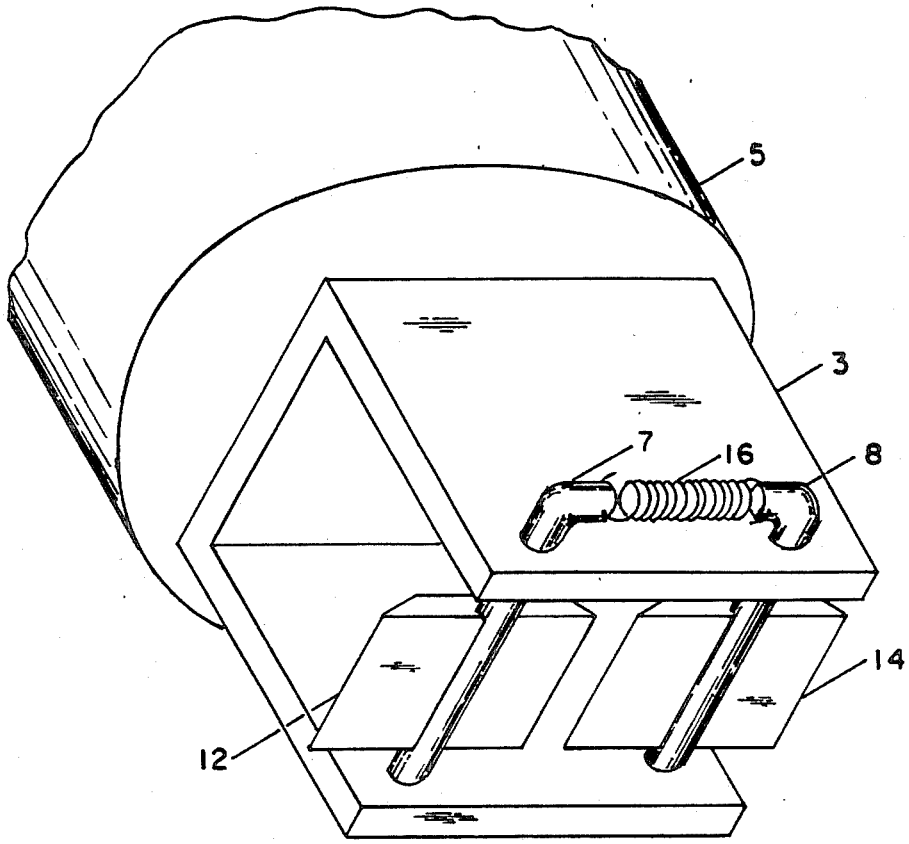
FIG. 1 illustrates the arrangement of parts of the present invention.

Referring to FIG. 1, a U-shaped bracket 3 is welded onto a solid metal weight 5. Two L-shaped round rods 7, 8 are inserted through four holes drilled through the bracket 3. These holes serve as rotation points and bearing surfaces for the rods 7, 8. A pair of jaws 12, 14 are tapered to points on the inwardly-facing and outwardly-facing edges. The jaws 12, 14 are welded to the rods 7, 8 with the inwardly-facing edges slightly separated and the outwardly-facing edges projecting past the edges of the bracket 3 by about one inch. When the jaws 12, 14 are welded to the rods 7, 8 they are placed horizontally with the bent ends of the rods 7, 8 also horizontal and facing inwardly. An expansion spring 16 is attached to these rod ends, retaining the rods 7, 8 and jaws 12, 14 in a horizontal position. The tool is lowered into the well casing with the bracket 3 and its assembly entering first. The weight 5, usually about fifteen inches in length, is attached on the opposite end, not shown, by a standard fitting to a cable, then lowered into the well casing.

Figure 2:
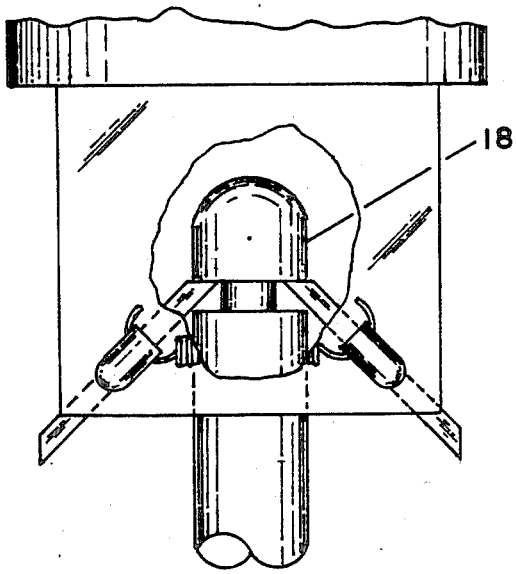
FIG. 2 shows the retriever latching onto the top rod of an oil and gas well swab.

FIG. 2 illustrates the fishing head rod 18 pushing between the rods into the bracket pushing the jaws to the side. The inwardly-facing edges of the jaws then slip into the slot cut into the rod 18, locking it in place until the swab is pulled out of the well casing.

Figure 3:
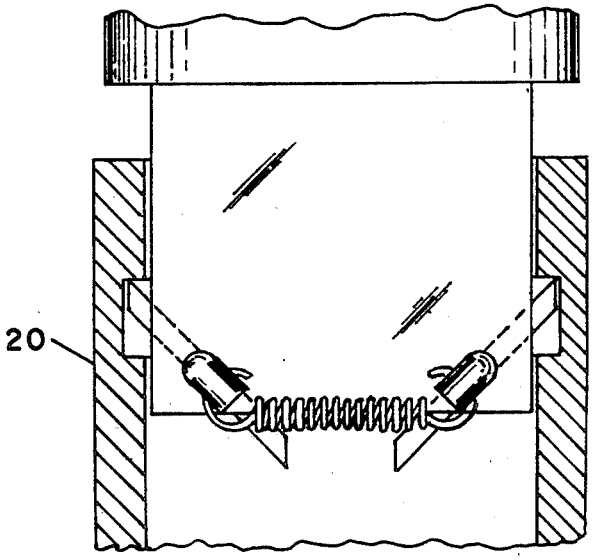
FIG. 3 represents the retriever latching into a down-hole stand.

In FIG. 3, the entire bracket assembly is pushed into the upwardly-facing tube of the down-hole stand 20. The outward edges of the jaws then slip into the internal slot in the stand tube, locking the retriever to the stand until both are pulled from the well casing.

Having disclosed my invention, what I claim as new and to be secured by Letters Patent of the United States is:

1. A tool for retrieving swabbing devices and down-hole stands in a casing or tubing for oil wells and other like wells which comprises:

a support member, at least two jaws pivotably supported from said support member so that they are pivotable both clockwise and counterclockwise as seen from one side, said jaws each having holding means at their respective outboard aspects and at their respective inboard aspects and each having a pivot axis disposal effectively between its said respective outboard and inboard aspects;

resilient means interconnected to said jaws so that said jaws have their outboard aspects urged towards said casing or tubing and their inboard aspects urged away from said casing or tubing and towards each other, the arrangement being such that said jaws' holding means are enabled to pivot relative to their respective said pivot axes in first opposite directions around a centrally disposed object such as a swabbing device, in said casing or tubing so that the inboard aspects of each said holding means are urged by said resilient means to engage such object for lifting same, and also to pivot about their respective pivot axes in second opposite directions relative to their respective said pivot axes in contacting an object such as a down-hole stand disposed close to the interior walls of said casing or tubing again so that the outboard aspects of each said holding means are urged to engage such latter object for lifting same.

2. A tool in accordance with claim 1 wherein said jaws comprise plates which are urged in a coplanar disposition by said resilient means.

3. A tool in accordance with claim 1 wherein said plates generally have a parallelogram configuration in vertical cross-section and said holding means comprise the acute angled edges of said plates.

4. A tool in accordance with claim 1 comprising pivot means for pivotally supporting said jaws wherein said resilient means comprises a tension spring which connects said pivot means together.

* * * * *